US005411633A

United States Patent [19]

Phillips et al.

[11] Patent Number: 5,411,633

[45] Date of Patent: May 2, 1995

[54] MEDIUM CONSISTENCY PULP OZONE BLEACHING

[75] Inventors: Joseph R. Phillips; Brian F. Greenwood; Erwin Funk; Stephen Dunn, all of Glens Falls, N.Y.

[73] Assignee: Kamyr, Inc., Glens Falls, N.Y.

[21] Appl. No.: 693,287

[22] Filed: Apr. 30, 1991

[51] Int. Cl.[6] ..... D21C 9/153

[52] U.S. Cl. ..... 162/52; 162/57; 162/65

[58] Field of Search ..... 162/65, 52, 246, 57

[56] References Cited

U.S. PATENT DOCUMENTS 4,486,286 8/1984 Johnson ..... 162/65

FOREIGN PATENT DOCUMENTS

WO90/13344 11/1990 European Pat. Off. .
0397308 11/1990 European Pat. Off. .
426652 5/1991 European Pat. Off. .
2620744 3/1989 France ..... 162/65

OTHER PUBLICATIONS

Das Papier, Sinotex®, "Medium Consistency Ozone Bleaching: Laboratory and Mill Experience", Sixta et al; Oct., 1991 No. 10, pp. 610–625.

"Ozone Bleaching: Medium Consistency Technology and Mill Experience" Sixta et al; pp. 1–13, 2 dwg Figures (Admitted Prior Art).

"MC® Ozone Bleaching; Kamyr AB/Lenzing Pilot System" Drawing-(Admitted Prior Art).

"Medium Consistency Ozone Bleaching", Laxen et al; pp. 1–10, 5 dwgs Figures (Admitted Prior Art).

*Primary Examiner*—Steve Alvo
*Attorney, Agent, or Firm*—Nixon & Vanderhye

[57] ABSTRACT

Medium consistency (e.g. about 6–15%) paper pulp is effectively bleached with ozone in a carrier gas (typically oxygen) by effecting efficient separation of carrier gas from the pulp after reaction with the ozone, and introducing the ozone into the pulp at a pressure of about 10–13 bar. Ozone in oxygen and medium consistency paper pulp are fed to a fluidizing mixer; the intimate uniform mixture produced is then passed upwardly in a reaction vessel until about 99% of the ozone has been consumed, and then separation of gas from the pulp is initiated by moving the pulp mixture into a generally horizontal tube leading to a gas zone in a large diameter retention vessel. A pressurized gas pad is maintained at and above the introduction of the pulp into the retention vessel, while the level of pulp in the retention vessel is maintained below the point of introduction. The pulp may be withdrawn from the retention vessel with a fluidizing degassing pump, and the pressurized gas removed from the top of the vessel may be fed to an apparatus using oxygen gas under pressure.

6 Claims, 2 Drawing Sheets

MEDIUM CONSISTENCY PULP OZONE BLEACHING

BACKGROUND AND SUMMARY OF THE INVENTION

It has long been known that ozone is capable of efficiently bleaching paper pulp. Despite numerous environmental, efficiency, and other advantages associated with utilizing ozone to bleach paper pulp, however, at the present time no commercially significant installations exist for ozone bleaching. A significant reason for this is the inability to control the ozone bleaching reaction, which is extraordinarily rapid, and the inability to intimately mix sufficient quantities of ozone in carrier gas with pulp.

In recent years, equipment has been developed, such as the MC® mixer manufactured and sold by Kamyr, Inc. of Glens Falls, N.Y., which can effect intimate mixing of ozone with paper pulp even though the pulp is at medium consistency (i. e. about 6–15%, preferably about 8–12%). However, even with this equipment, there are difficulties in getting enough ozone into intimate contact with the pulp in a uniform manner, and if the ozone is not uniformly mixed with the pulp the ozone will attack the carbohydrate component of the pulp (in addition to the lignin) in localized area, and thereby significantly degrade the pulp. The problem with getting enough ozone into intimate, uniform, contact with the pulp results since the ozone cannot be added alone, but must be included in a carrier gas. Air and oxygen are the two most common carrier gases, although nitrogen can also be used. Oxygen allows the greatest percentage of ozone to be included therein, but even when oxygen is used as the carrier gas, the percentage of ozone therein is typically only about 3–10%.

Since the ozone is so dilute in the carrier gas, attempts have been made to introduce the ozone under pressure into contact with the carrier gas; however, in the pressure range of 7–8 bar or less, the presence of the carrier gas limits the total amount of ozone which can be effectively added in a single stage. Under the same conditions, it is commercially difficult to perform carrier gas separation at medium consistency after bleaching even utilizing medium consistency pulp handling degassing devices and pumps, such as those sold by Kamyr, Inc. of Glens Falls, N.Y. under the trademark "MC" ®.

According to the present invention, an apparatus and method are provided which allow effective treatment of medium consistency pulp with ozone. According to the present invention, more ozone can be added than is conventionally possible since degassing of the carrier gas from the pulp is effectively practiced during normal processing, and without the addition of significant energy consuming appliances, only one degassing pump being necessary. Practicing the invention, then, it is possible to add ozone with carrier gas to a fluidizing mixer, so as to intimately and uniformly mix the ozone with medium consistency pulp, at a pressure of about 10–13 bar, yet still achieve effective degassing.

According to one aspect of the present invention, a method is provided for ozone bleaching paper pulp having a consistency of about 6–15% throughout treatment, using a mixer, comprising the following steps: (a) Feeding ozone in a carrier gas, under a pressure substantially greater than 1 bar (preferably at about 10–13 bar), and paper pulp having a consistency of about 6–15%, to the mixer. (b) Effecting intimate and uniform mixing of the pulp and ozone in the mixer. (c) Passing the intimate mixture of ozone and pulp in a first path from the mixer, retaining it in the first path a first time period (e.g., at least about 10–30 sec.) sufficient for at least 90% of the ozone to react with the pulp to effect bleaching thereof. (d) Moving the pulp which has reacted with ozone in a second path, markedly different than the first path, so that separation of gas in the pulp and the pulp occurs, while the gas is maintained under pressure. (e) Removing separated gas from step (d) in a third path, while retaining it under pressure; and (f) removing pulp with gas separated therefrom, from step (d), in a fourth path. Step (c) is preferably practiced by passing the mixture in a vertically upward path, and step (d) is practiced by passing the mixture in a horizontal path where gas and pulp separation begins, and then feeding it into an enlarged diameter retention vessel, to a gas pad (chamber) in the vessel, above the level of paper pulp in the vessel, While the pulp is in the retention vessel, further separation of gas from pulp takes place, allowing the pulp to be pumped from the vessel and simultaneously effectively degassed with a single fluidizing degassing pump.

According to another aspect of the present invention, a method of bleaching paper pulp with ozone utilizing a fluidizing mixer, is provided which comprises the steps of continuously and sequentially: (a) Feeding paper pulp at a consistency of about 8–12% and ozone in a carrier gas at a pressure of about 10–13 bar into the fluidizing mixer. (b) Intimately and uniformly mixing the ozone and carrier gas with the pulp in the mixer. (c) Transporting the intimate mixture of gas and pulp from the mixer while retaining the gas and pulp in contact with each other a sufficient amount of time for about 99% of the ozone to react with the pulp to effect bleaching thereof; and then (d) effecting separation of the carrier gas from the pulp while still at the reaction pressure before further treatment of the pulp.

Apparatus is also provided according to the invention. The invention contemplates ozone bleaching apparatus for paper pulp having medium consistency, comprising the following components: A fluidizing mixer for fluidizing paper pulp at medium consistency while mixing ozone in a carrier gas therewith. An ozone in carrier gas inlet line to the mixer. A pulp inlet line to the mixer. A pulp/ozone mixture outlet line from the mixer. A vertical reaction vessel having a top, a bottom, and a first cross-sectional area, connected to the outlet line at the bottom thereof and transporting pulp mixed with ozone upwardly from the mixer. A generally horizontal tube connected to the top of the vertical reaction vessel, for initiating separation of gas within the pulp from the pulp, and having a second cross-sectional area. A pressurized upright retention vessel having a top and a bottom, and having a third cross-sectional area, significantly greater than the first or second cross-sectional areas, the retention vessel connected to the horizontal tube at a connection point near, but spaced from, the top of the retention vessel. A pulp discharge from the bottom of the retention vessel. A pressurized gas discharge from the top of the retention vessel; and means for maintaining the pulp in the retention vessel at a level below the connection point of the tube to the retention vessel, and maintaining a pad of pressurized gas above the pulp.

Preferably, a curved elbow is provided between the vertical reaction vessel and the generally horizontal tube for connecting them together, and the first and second cross-sectional areas are approximately equal. Also, the reaction vessel and tube and retention vessel are all circular in cross-section, with the diameter of the retention vessel being about twice as great as the diameters of the reaction vessel and tube.

It is a primary object of the present invention to provide for the effective ozone bleaching of medium consistency paper pulp, without requiring substantial energy consuming degassing appliances, and while effectively utilizing oxygen containing carrier gas removed from the pulp after bleaching. This and other objects of the invention will become clear from an inspection of the detailed description of the invention, and from the appended claims.

DETAILED DESCRIPTION OF THE DRAWING

Figure 1A:
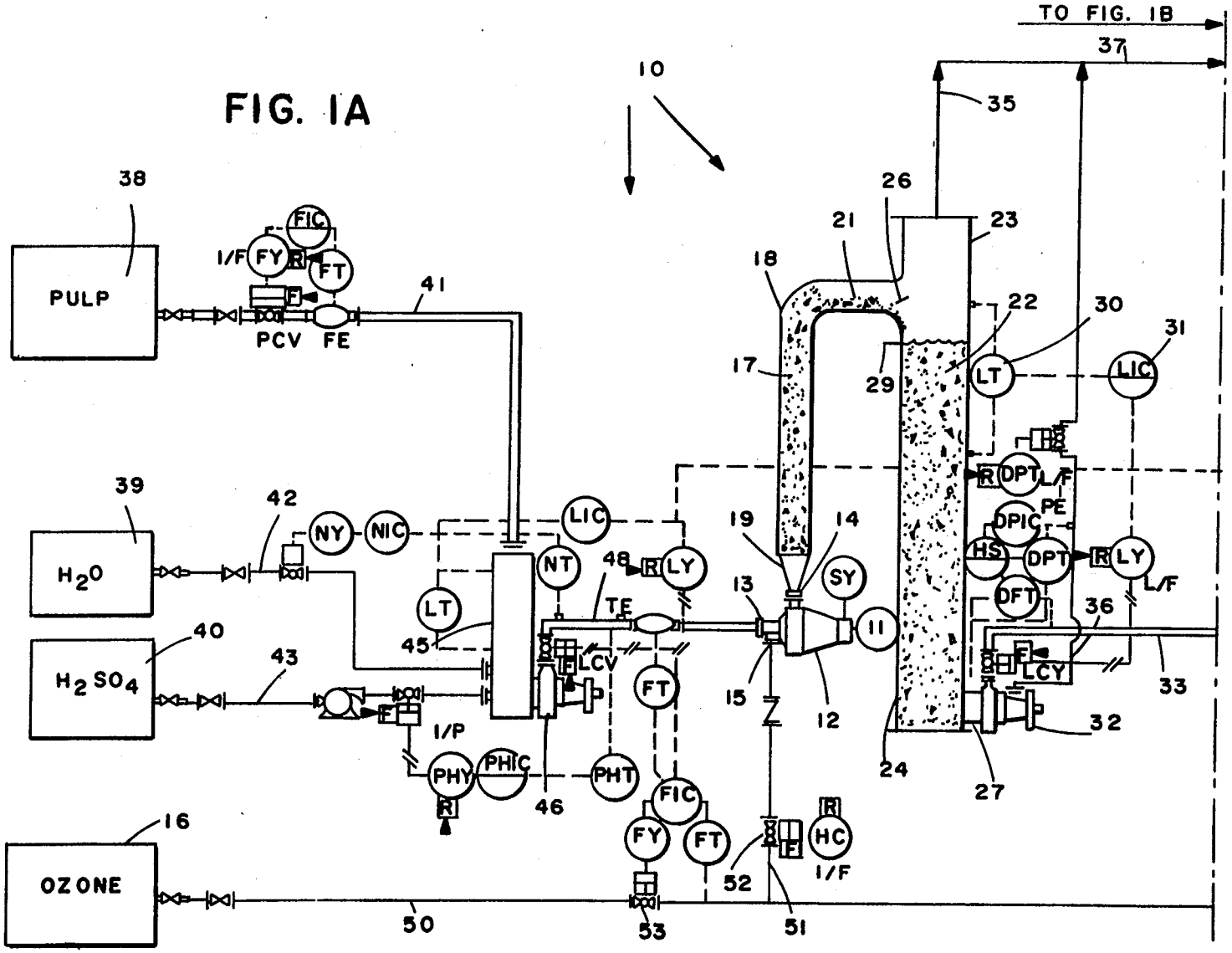
FIGS. 1A and 1B are a schematic showing of exemplary apparatus for effectively ozone bleaching paper pulp according to the invention, and for practicing exemplary methods according to the invention.

Exemplary apparatus for ozone bleaching paper pulp having medium consistency (about 6–15%, preferably about 8–12%), is schematically illustrated generally by reference numeral 10 in FIG. 1A. One of the major components of the apparatus 10 is a fluidizing mixer 12 having a pulp inlet 13, a pulp/ozone outlet 14, and an ozone inlet 15 provided with ozone containing gas from source 16. The ozone is provided in a carrier gas. While the carrier gas can be air or nitrogen, oxygen is preferred. The highest concentration of ozone presently feasible to produce in an air fed ozone generator is only about 2–3%. When oxygen is the feed material to the ozone generator and carrier gas, it is presently technologically practical to have a maximum content of ozone above 11–12%, although typically 3–10% by weight is the norm. Therefore, in the preferred embodiment, the ozone containing gas from source 16 comprises about 88–97% oxygen and about 3–10% ozone (or higher if techniques are developed to provide a higher percentage of ozone in oxygen on a practical basis). There will be minor amounts of other gases, such as the gases that make up air, which should have no significant adverse effect on the delignifying action produced by the ozone.

Fluidizing mixer 12 preferably is of the type sold by Kamyr, Inc. of Glens Falls, N.Y. under the trademark "MC" ® mixer which has the ability to intimately mix the ozone gas with medium consistency pulp by fluidizing the pulp, but other designs of fluidizing medium consistency mixers will also work in this application. Connected to the pulp/ozone outlet 14 at the top of the mixer 12 is generally vertical reaction vessel 17 which has a top 18 and a bottom 19, and a first cross-sectional area. Preferably the reactor 17 is circular in cross section. Pulp intimately and uniformly mixed with ozone passes upwardly from mixer 12 and the reactor chamber 17.

At the top 18 of the reactor vessel 17 is a generally horizontally extending tube 21, the top 18 comprising a curved elbow for connecting the vessel 17 to tube 21. The tube 21 has a second cross-sectional area; preferably the second cross-sectional area is about the same as the first cross-sectional area (of the vessel 17) and, the tube 21 also is preferably circular in cross-section. The tube 21 is connected at one end thereof to the top 18 of the vessel 17 and at the other end thereof opens up into a gas chamber 26 within a pressurized upright retention vessel 22. Vessel 22 has a top 23 and a bottom 24, with a pulp discharge conduit 27.

The pressurized upright retention vessel 22 has a third cross-sectional area which is significantly greater than the first or second cross sectional areas. For example, the vessel 22 is also preferably circular in cross section, and has a diameter of about one and one-half to three times the diameter of the vessel 17.

The gas chamber 26 is maintained at the top of the vessel 22 by controlling the level 29 of pulp within the vessel 22, utilizing the conventional level sensor 30 preferably connected to a level controller 31, which in turn is connected to a control valve on the outlet of discharge pump 32 for pumping pulp out of the discharge conduit 27 of the vessel 22. The pump 32 preferably is a degassing fluidizing pump, of the type sold by Kamyr, Inc. of Glens Falls, N.Y. under the trademark "MC" ®. Such a pump 32 simultaneously pumps and degasses medium consistency pulp, effecting fluidization of the pulp during pumping.

Because the vessel 17—through tube 21—opens into the gas chamber 26 at the top of the vessel 22, separation of a gas within the pulp from the pulp is initiated in the tube 21, and continues as the pulp free falls into vessel 22. Also, the gas chamber 26, and the relatively large cross-sectional area of the vessel 22, provide a substantial length of time and substantial area of pulp within the vessel 22 at the interface between the pulp and the gas in chamber 26 (at level 29) so that further separation of gas and pulp takes place in the vessel 22.

When the ozone containing gas is intimately mixed with the pulp in the mixer 12, and it passes into the reaction vessel 17, the ozone almost instantly reacts with the pulp. It reacts with such rapidity that typically within about 10 seconds almost the entire content (e.g., about 99%) of added ozone has reacted. However, a substantial amount of carrier gas, plus possibly gasses produced by the reaction of ozone with lignin, and gas originally present in the pulp, exists near the top 18 of the vessel 17. This gas must be removed before further handling of the pulp. In the prior art, the amount of the ozone added to the pulp was limited by the ability of the pump 32, or the like, to degas the pulp after ozone treatment. However, according to the invention, since there are substantial time and mechanism for pulp and gas separation due to the provision of the conduit 21 opening up into the gas chamber 26 at the top of the vessel 22, and the relatively large pulp residence time within the vessel 22, and relatively large cross-sectional area of the vessel 22, a great deal of gas has been removed before the pulp gets to the degassing pump 32. Therefore, more ozone can be added to the mixer 12 than is practiced by the prior art, allowing a more complete reaction, which is important, especially where—as here—medium consistency pulp has been treated.

Using the apparatus of FIG. 1, and practicing the method according to the invention, it is possible to add ozone containing gas to the mixer 12 under a pressure greater than the 7–9 bar which is the maximum that has heretofore been utilized. According to the invention, the ozone containing gas may be provided in source 16, and fed to the mixer 12, at a pressure of about 10–13 bar, preferably about 11–12 bar. Thus, even though the active agent—ozone—in the gas may only be about 3–10% by weight, because the gas is under high pressure, a substantial amount of ozone is intimately brought into contact with the pulp in the mixer 12.

Eventually the gas that separates from the pulp in tube 21 and the top 23 of the vessel 22, must be removed. This is accomplished by the pressurized gas discharge line 35 from the top of the retention vessel 22. Gas removed by the degassing pump 32 is fed via line 36 into a common conduit 37 with the gas in line 35. A pressure controlled valve 34 in the line 37 maintains the gas pressurized at the top of the vessel 23. The gas is maintained in the chamber 26 with substantially the same pressure (or somewhat less) than was introduced in the mixer 12 so that gas will freely separate from the pulp, and move into gas chamber 26, yet the gas will be pressurized so that energy can be conserved and used in another place within a pulp mill without the need for re-pressuring it from atmospheric.

While the basic apparatus 10 according to the invention has been described above, it is to be understood that various other structures are typically associated with the apparatus 10. For example, pulp is supplied from a source 38, the pulp typically being provided from source 38 with a consistency of about 6–15%, such as from a brown stock high-density storage unit. Typically the pulp has a temperature of around 50°–60° C. from such a conventional storage. Water from source 39, and $H_2SO_4$ from source 40 typically are added to the pulp. The pulp flows through line 41 from the source 38, while the water flows from line 42 and the $H_2SO_4$ in line 43. Lines 41–43 are all connected to the vessel 45, in which they are mixed together. The water typically has a temperature of about 10°–20° while the $H_2SO_4$ typically has a temperature of about 10°–30°. For a pulp flow of 1390–2010 GPM (about 8–12 percent consistency), typically about 0–280 GPM of water are added in vessel 45 and about 12–25 GPM of $H_2SO_4$. Regardless of the amount of water and $H_2SO_4$ added, the consistency of the pulp is maintained in the 6–15% range (preferably about 8–12%).

From the vessel 45, the pulp is pumped via the conventional fluidizing pump 46 in line 48 to the mixer 12 pulp inlet 13. The pump 46 preferably is a fluidizing pump, like the pump 32, and it may effect degassing during pumping so that the pulp supplied in line 48 is as free of gas as practical.

Note that the ozone containing gas from source 16 is supplied via line 50, and then through branch conduit 51, to the ozone inlet 15 to mixer 12. Line 51 has an HC controlled valve assembly 52 therein. A flow responsive valve 53 is provided in the conduit 50 to provide amounts of ozone and carrier gas at a ratio of the supply pulp. The gas discharged in line 37, after passing through pressure control valve 34, goes to the exhaust 55, which may have an ozone destruction device. By the time the gas reaches the ozone destruction device 55, about 99% of the ozone originally present in it has already reacted, the vast majority, if not all, in the vessel 17.

After ozone destruction, the gas from line 37 can be led, via branch conduit 56, to an EO bleach stage. The gas in line 56, having been maintained under pressure, is at approximately under the right pressure for an EO bleach stage. Alternatively, the gas can pass in branch line 59 and pass through a compressor 60 where the pressure of it is raised slightly, and it can be used as an oxygen feed gas for a high or medium consistency oxygen bleaching unit 61. Because the pressure of the separated gas—which is preferably almost all oxygen (e.g., about 98%+ oxygen)—the amount of energy necessary to act on the gas to utilize it in an EO stage is essentially 0, and to use it in the stage 61 is minimal, the compressor 60 only having to raise the pressure of the gas slightly.

Figure 1B:
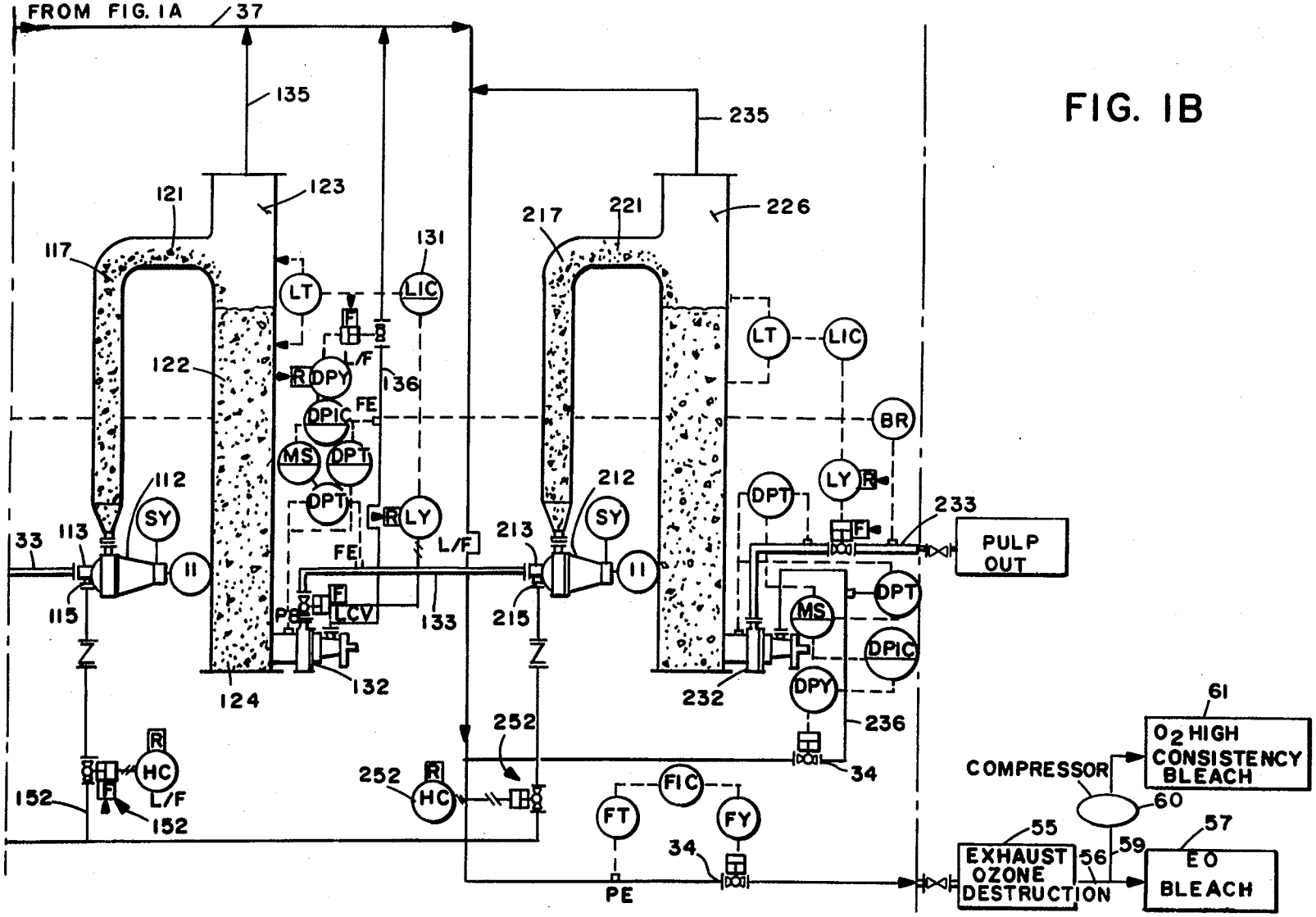

While according to the invention ozone bleaching can effectively be practiced in one stage, there are many situations when it will be desirable to practice it in multiple stages to achieve a higher degree of brightness or delignification and/or depending upon the particular pulp being treated, subsequent steps for acting on the pulp, etc. In FIG. 1B, two subsequent stages essentially identical to the apparatus 10 are illustrated. In the second stage, components equivalent to those in apparatus 10 are shown in the same two-digit reference numeral only preceded by "1", while in the third stage, components equivalent to those in the apparatus 10 are shown in the same two-digit reference numeral only preceded by "2". The pulp finally discharged from the discharge line 233 for the third stage ozone delignification reaction, would—given the flow from source 38 described above—have a flow rate of about 1330–2000 GPM, and a temperature of about 60° C.

The pressure controlled valve 34 provides a common pressure for all of the gasses being discharged in the lines 35, 135, 235. The flow controlled valve 53 provides the ozone containing gas from source 16 to all hand control valves 52, 152, and 252 which distribute the gas in desired split proportions to inlets 15, 115, 215 of the mixers 12, 112, 212.

Utilizing the apparatus heretofore described, a method of ozone bleaching paper pulp, having a consistency of about 6–15% throughout, is provided. A method comprises the following steps.

(a) Feeding ozone in a carrier gas (from 16), under a pressure substantially greater than 1 bar, and paper pulp having a consistency of about 6–15%, to the mixer 12. (b) Effecting intimate and uniform mixing of the pulp and ozone in the mixer 12. (c) Passing the intimate uniform mixture of ozone and pulp (with a pH of about 2–5) in a first path (into vessel 17) from the mixer 12, retaining it in the first path a first time period (e.g., at least about 10–20 seconds) sufficient for at least 90% of the ozone to react with the pulp to effect bleaching thereof. (d) Moving the pulp which has reacted with ozone in a second path (into tube 21), markedly different than the first path, so that separation of gas in the pulp and the pulp occurs, while the gas is maintained under pressure. (e) Removing separated gas from step (d) in a third path (line 35), while retaining it under pressure; and (f) removing pulp with gas separated therefrom, from step (d), in a fourth path (into line 33 through degassing pump 32).

In the method as recited above, step (a) is practiced by feeding the ozone to the mixer 12 at a pressure of about 7–13 bar, preferably about 10–13 bar. Steps (b) and (c) are typically practiced so that about 99% of the ozone reacts with the pulp prior to step (d). Also, steps (e) and (f) are preferably practiced by feeding the second, horizontal, path (tube 21) into a first vertical position near the top 23 of an upright vessel 22 having a significantly greater cross-sectional area than the cross-sectional areas of the first and second paths; maintaining a pulp level (at 29) within the upright vessel 22 below the first vertical position, so that a gas pad 26 is provided in the top of the upright vessel; and withdrawing gas under pressure in the third path 35 from the top 23 of the upright vessel 22, and withdrawing pulp in the fourth path 33 from the bottom 24 of the upright vessel 22.

The pulp level maintaining step is preferably practiced by maintaining the pulp at a level so that the vessel is about 60–80% full of pulp. Step (a) is preferably practiced by feeding the ozone in oxygen as the carrier gas. The method may also comprise the further step of feeding the gas withdrawn under pressure from step (e) in line 35 to a process step utilizing pressurized oxygen gas (e.g., EO bleach stage 57, or high consistency $O_2$ bleach stage 61). Step (f) is preferably practiced by simultaneously pumping the pulp from the bottom 24 of the vessel 22 while degassing it further (with pump 32); and the method comprises the further step of combining the gas discharged from the simultaneous pumping and degassing of the pulp (in line 36) with the gas from step (e) (combined in line 37).

Steps (a) through (f) are preferably practiced at least one more time, utilizing as feed pulp the pulp discharged from the bottom of the vessel, and preferably are repeated twice. The pulp is maintained in each of the upright vessels (22, 122, 222) a substantial period of time (e.g., at least several minutes), to allow further separation of gas therefrom, prior to discharge of the pulp through the bottom of the vessel.

It will thus be seen that according to the present invention, a method and apparatus for the ozone bleaching of medium consistency pulp are provided which allow more ozone to be effectively applied to the pulp in each stage, while still allowing proper transport of the pulp since it is effectively degassed. Also the method and apparatus allow the utilization of separated gas in other processes without significant energy penalty for recompressing the gas, and provide a single pressure controlled value (34) for controlling pressure of the gas, and a single flow controlled valve 53 for controlling the ratio of ozone to pulp which is then split to all of the stages (mixtures 12, 112, 212).

While the invention has been herein shown and described in what is presently conceived to be the most practical and preferred embodiment thereof, it will be apparent to those of ordinary skill in the art that minor modifications may be made thereof within the scope of the invention, which scope is to be accorded the broadest interpretation of the appended claims so as to encompass all equivalent structures and methods.

What is claimed is:

1. A method of ozone bleaching paper pulp having a consistency of about 6–15% throughout treatment, using a mixer, comprising the steps of:

(a) feeding ozone in a carrier gas, under a pressure substantially greater than 1 bar, and paper pulp having a consistency of about 6–15% to the mixer;

(b) effecting intimate and uniform mixing of the pulp and ozone in the mixer;

(c) passing the intimate uniform mixture of ozone and pulp in a first path from the mixer, retaining it in the first path a first time period sufficient for at least 90% of the ozone to react with the pulp to effect bleaching thereof;

(d) moving the pulp which has reacted with ozone in a second path, markedly different than the first path, so that separation of gas in the pulp and the pulp occurs, while the gas is maintained under pressure;

(e) removing separated gas from step (d) in a third path, while retaining it under pressure;

(f) removing pulp with gas separated therefrom, from step (d), in a fourth path; wherein step (c) is practiced by passing the mixture in a vertically upward path, and step (d) is practiced by passing the mixture in a horizontal path, where gas and pulp separation begins; and wherein steps (e) and (f) are practiced by feeding the second, horizontal, path into a first vertical position near the top of an upright vessel having a significantly greater cross-sectional area than the cross-sectional areas of the first and second paths; maintaining a pulp level within the upright vessel below the first vertical position, so that a gas pad is provided in the top of the upright vessel; and withdrawing gas under pressure in the third path from the top of the upright vessel, and withdrawing pulp in the fourth path from the bottom of the upright vessel.

2. A method as recited in claim 1 wherein the pulp level maintaining step is practiced by maintaining the pulp at a level so that the vessel is about 60–80% full of pulp.

3. A method as recited in claim 1 wherein step (a) is practiced by feeding the ozone in oxygen as the carrier gas; and comprising the further step of feeding the gas withdrawn under pressure from step (e) to a process step utilizing pressurized oxygen gas.

4. A method as recited in claim 1 wherein step (f) is practiced by simultaneously pumping the pulp from the bottom of the vessel while degassing it further; and comprising the further step of combining the gas discharged from the simultaneous pumping and degassing of the pulp with the gas from step (e).

5. A method as recited in claim 1 comprising the further step of repeating steps (a) through (f) at least one more time, utilizing as feed pulp the pulp discharged from the bottom of the vessel.

6. A method as recited in claim 1 wherein the pulp is maintained in the upright vessel a substantial period of time, to allow further separation of gas therefrom, prior to discharge of the pulp through the bottom of the vessel.

* * * * *